US006890068B2

(12) United States Patent
Kawamura et al.

(10) Patent No.: US 6,890,068 B2
(45) Date of Patent: May 10, 2005

(54) INK CONTAINMENT SYSTEM FOR AN INK-JET PEN

(75) Inventors: Naoto Kawamura, Corvallis, OR (US); Timothy L. Weber, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/309,869

(22) Filed: Dec. 4, 2002

(65) Prior Publication Data

US 2003/0081089 A1 May 1, 2003

Related U.S. Application Data

(63) Continuation of application No. 08/548,568, filed on Oct. 26, 1995, now abandoned.

(51) Int. Cl.[7] ..... B41J 2/175

(52) U.S. Cl. ..... 347/86

(58) Field of Search ..... 347/85–87

(56) References Cited

U.S. PATENT DOCUMENTS 5,671,001 A * 9/1997 Elliot et al. ..... 347/87
6,325,498 B1 * 12/2001 Higuma et al. ..... 347/86

FOREIGN PATENT DOCUMENTS

GB 2 067 474 A * 7/1981 ..... B43K/1/00
JP 61-012352 * 1/1986 ..... 347/36
JP 07-052404 * 2/1995 ..... B41J/2/175

* cited by examiner

*Primary Examiner*—Michael S. Brooke

(57) ABSTRACT

A porous foam based ink containment system is provided with grooves defined in the exterior portion thereof, for storing ink, while preventing ink leakage from the ink-jet pen. The grooves provide passageways to allow air diffused throughout the ink and trapped air bubbles within the foam to expand and move to the atmosphere. An atmospheric vent is in fluid communication with at least one of the grooves.

24 Claims, 4 Drawing Sheets

INK CONTAINMENT SYSTEM FOR AN INK-JET PEN

CROSS REFERENCE TO RELATED APPLICATION

This is a continuation of application Ser. No. 08/548,568 filed on Oct. 26, 1995, now abandoned which is hereby incorporated by reference herein.

TECHNICAL FIELD

The present invention is directed to a foam-based ink containment system for an ink-jet printer.

BACKGROUND AND SUMMARY OF THE INVENTION

An ink-jet printer includes a pen in which small droplets of ink are formed and ejected from the printer pen toward a printing medium. Such pens include printheads with orifice plates with several very small nozzles through which the ink droplets are ejected. Adjacent to the nozzles are ink chambers, where ink is stored prior to ejection through the nozzle. Ink is delivered to the ink chambers through ink channels in fluid communication with an ink supply. The ink supply may be, for example, contained in a reservoir part of the pen.

For color printing, multiple colors are made available to the printer. For each color of ink there is a separate ink reservoir and ink delivery system coupled to a separate group of ink chambers and nozzles. In order to achieve high quality, high-resolution printing, these groups of nozzles are placed relatively close together on the printhead. Control of ink flow is required to prevent excess ink from being delivered to the printhead. Excess ink delivery leads to leakage, or drooling from the nozzles.

Ink-jet printer systems are affected by changes in ambient conditions, such as temperature and pressure. When the ambient temperature increases or ambient pressure decreases, air diffused throughout the ink and air bubbles present within the ink reservoir expand to cause displacement of ink. Unless this expansion is managed, the displaced ink is forced out the printhead nozzles resulting in undesired drool.

When an inkjet pen drools, one color of ink may migrate across the surface of the printhead to another color group. When ambient temperature or pressure changes, the migrated ink may be sucked back into the nozzles of another color ink. The mixing of these two ink colors causes contamination, producing poor quality printing.

Open cell foam is often used to store ink within a reservoir of an ink jet pen. In conventional foam ink storage systems, the top of the reservoir may be vented to ambient to allow equalization of pressure within the ink container to the outside air pressure. However, substantially all of the exterior surfaces of conventional foam ink storage members are in contact with the walls of the pen reservoir. Such contact between ink saturated foam and the reservoir walls creates a seal through which air is unable to pass for venting to atmosphere. When changes in ambient conditions occur to expand air in the reservoir, the expanded trapped air displaces ink and causes drool through the nozzles.

To control leakage, extra felting of the foam member has been employed. Felting is a measure of the extent to which foam is compressed. Compressing the foam decreases the pore dimensions. By increasing the felting of the foam (i.e., the amount of compression of the foam), pore size decreases and capillary force increases. A greater capillary force increases back pressure within the reservoir. An increase in back pressure within the reservoir helps to prevent drool. However, extra felting of the foam does not aid removal of air trapped within the foam. Extra felting also reduces the foam's ink storage capacity. Moreover, extra felting makes manufacturing difficult, as the foam is difficult to insert in the necessarily small reservoir.

Grooved reservoir walls have been used to prevent ink drool. The grooves create a series of interconnected channels between the foam member and the reservoir walls. Expanding air from the foam's interior diffuses into these channels and is vented out of the reservoir. However, the grooved reservoir walls can be difficult to manufacture. Additionally, grooved reservoir walls can make the walls more flexible, and the pressure exerted by the compressed foam can deform the flexible reservoir walls so that the ink-jet pen does not fit properly within the printer.

The present invention is directed to a system for storing ink in a pen reservoir, while preventing ink leakage due to a change in ambient temperature or pressure. The system comprises porous grooved foam. The porous foam is grooved on the exterior portion to provide paths for air to move to the atmosphere. Thus, air within the interior portion of the foam may expand to the grooves on the exterior portion. An atmospheric vent is in fluid communication with at least one of the grooves, thereby to vent excess air within the reservoir. The grooved foam may be used in any of a variety of ink-jet pen reservoirs and may be implemented with any foam-based pen.

DETAILED DESCRIPTION OF PREFERRED EMBODIMENTS

Figure 1:
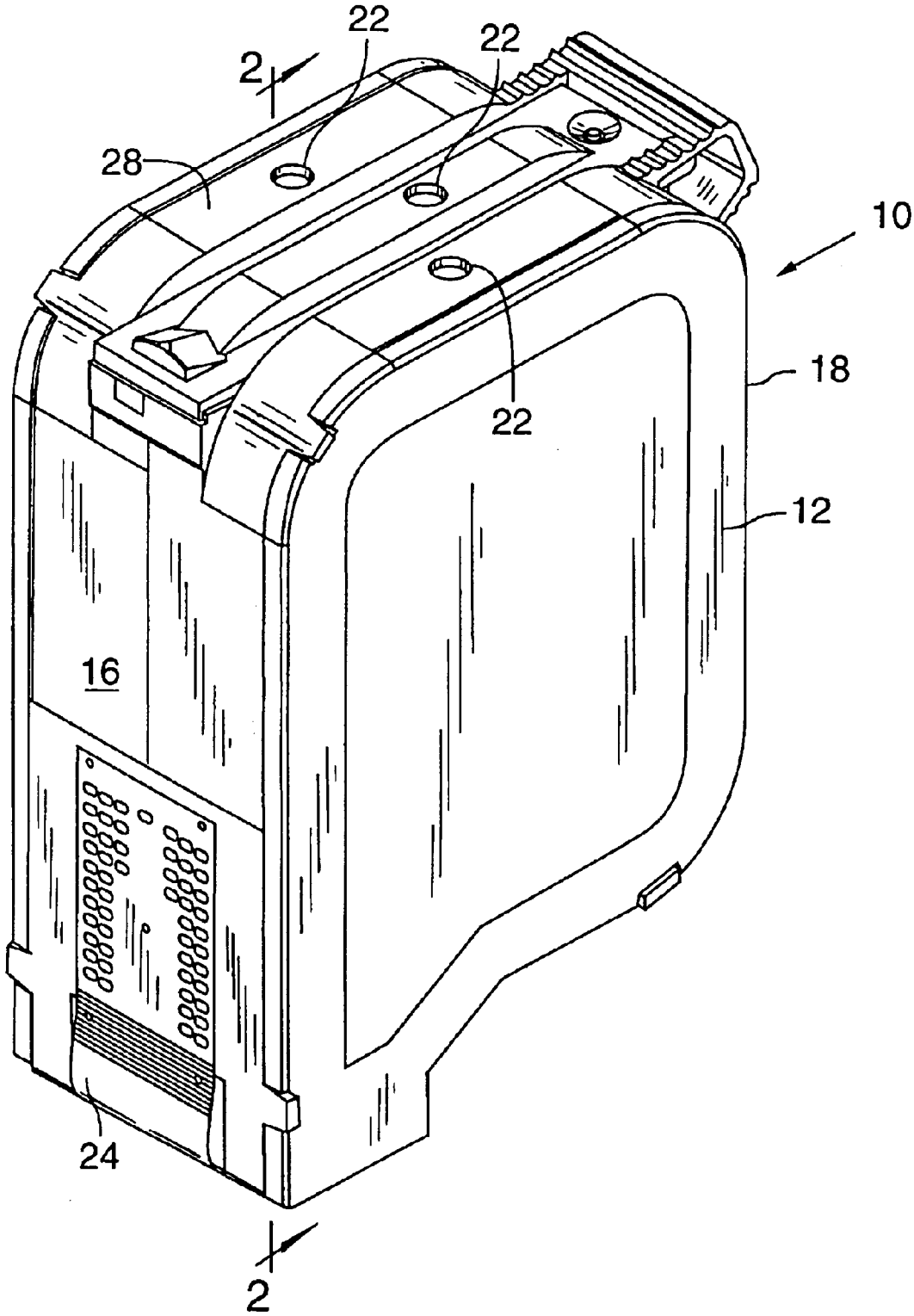
FIG. 1 is a perspective view of an ink-jet printer pen constructed in accordance with the invention.
Figure 2:
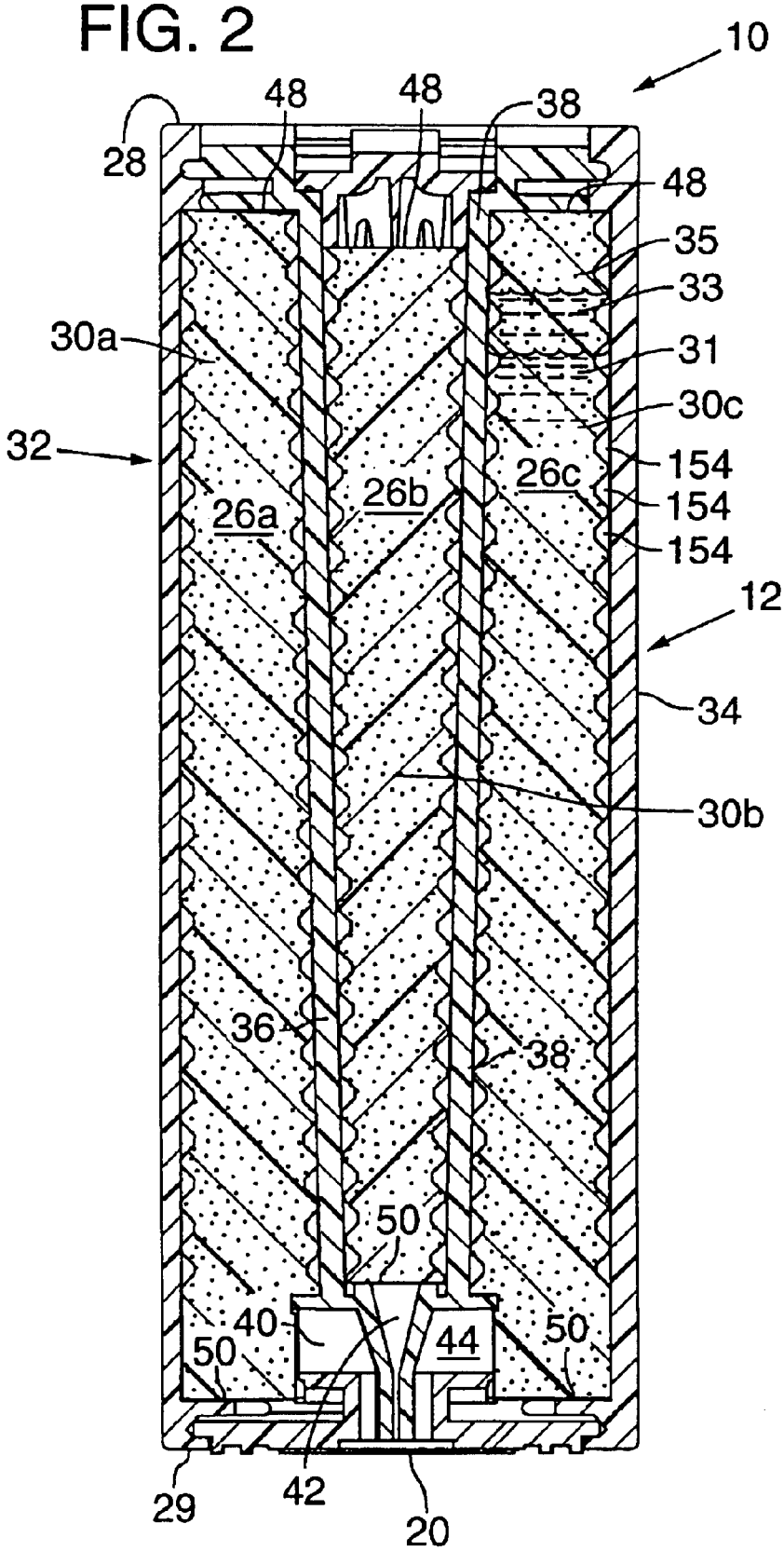
FIG. 2 is cross-sectional side view of the apparatus in FIG. 1 taken along line 2—2.
Figure 3:
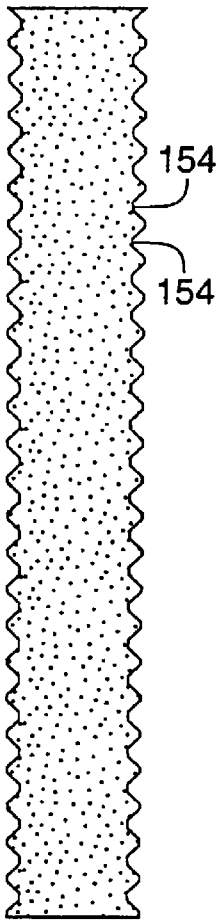
FIG. 3 is an end view of the foam member of the present invention.

FIG. 1 shows a three-color ink-jet cartridge 10 having a box shaped body 12. A printhead 20 is attached to the bottom of the pen body 12 (FIG. 2). The printhead 20 defines three separate sets of print orifices (not shown) that provide apertures for expelling ink in a controlled pattern during printing. The printhead 20 is electronically controlled through a connector circuit 24 mounted on the body 12.

Referring to FIG. 2, the body 12 defines three similar sized adjacent ink chambers 26*a*, 26*b*, 26*c*, (also referred to herein as reservoirs). On each side of the cartridge 10 there is a side cover 32, 34 each of which forms a respective wall of ink chambers 26*a* and 26*c*. The pen body 12 includes interior walls 36 and 38, which partially define ink chamber 26*b* and serve as the interior walls for ink chambers 26*a* and 26*c*.

Each ink chamber 26*a*, 26*b*, 26*c* is connected to ink outlets 40, 42, 44, respectively (FIG. 2). Each ink outlet is fluidly coupled to its associated set of print orifices of the printhead 20.

During manufacture, ink is introduced to the ink chambers by way of ink supply apertures 22 (FIG. 1) at the top 28 of the pen body 12. The supply apertures are plugged after completion of the ink filling process, but not entirely cut-off from atmospheric pressure. An atmospheric vent plug having a small or serpentine opening in it plugs each ink supply aperture to prevent the escape of ink. This type of atmospheric vent allows equalization of air pressure within the ink container to the outside air pressure as ink is ejected from the respective ink chamber. The vent also reduces pressure disequilibrium caused by changes in temperature or air pressure such as might be experienced with weather systems or changes in altitude of the printer itself.

Each chamber 26*a*, 26*b*, 26*c*, contains a different color ink, for instance, cyan, yellow and magenta. Each chamber is filled with a porous foam sponge 30*a*, 30*b*, 30*c* formed of open cell foam. The porous foam is capable of absorbing and storing liquid ink. In a preferred embodiment, each porous foam member 30*a*, 30*b*, 30*c* extends from the top end 48 of the ink chambers, at which the atmospheric vents (not shown) are located, to the bottom end 50 of the ink chambers (see FIG. 2). The foam member 30*a*, 30*b*, 30*c* additionally extends from a front side 16 of the pen body 12 (also referred to as a first end), to a back side 18 of the pen body (also referred to as a second end).

Figure 7:
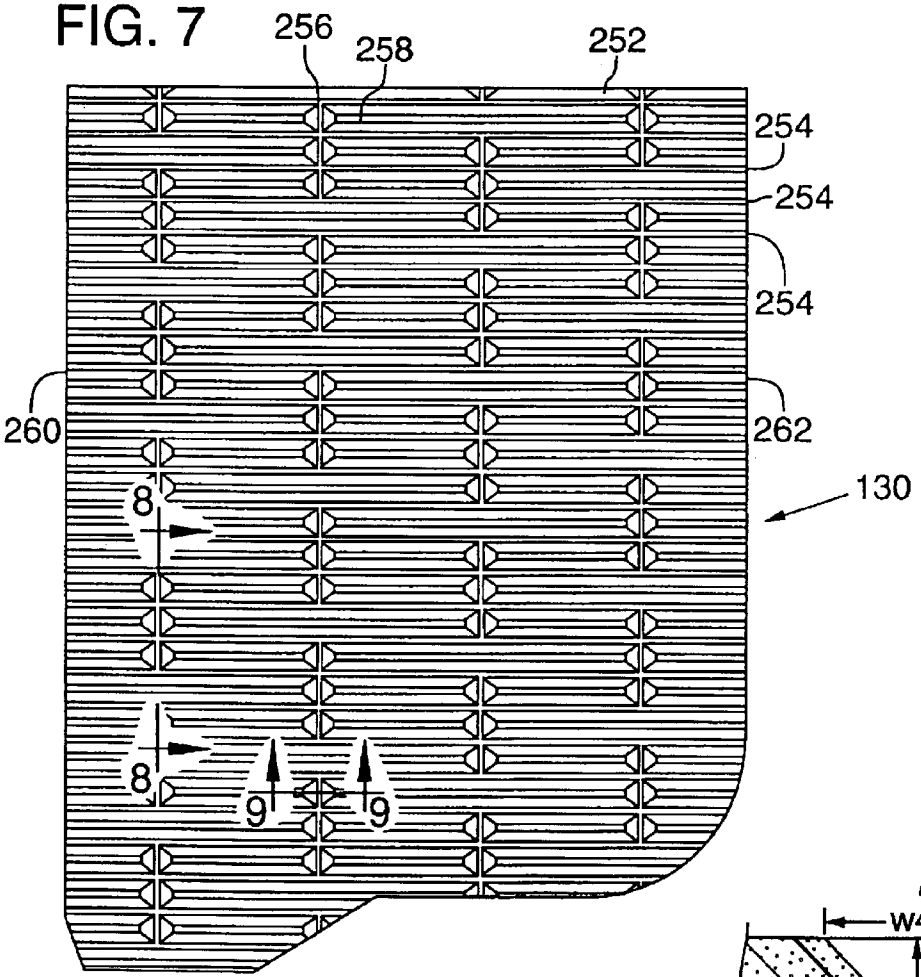
FIG. 7 is a side view of the foam constructed in accordance with another preferred embodiment of the present invention.

The foam members are substantially rectangular in shape (FIG. 7). The foam member 30 is oriented within an ink chamber such that a first end 260 is placed at the front side 16 of the ink-jet cartridge 10 and a second end 262 is placed at the back side 18 of the cartridge (FIG. 1).

The foam is a porous material having an extensive network of pores and capillaries. Ink for use by the printer is stored in the pores and capillaries. The porous foam members 30*a*, 30*b*, 30*c* are placed within the ink chambers 26*a*, 26*b*, 26*c*, respectively, and compressed between the walls of the chambers. That is, foam member 30*a* is compressed between the interior of walls 32 and 36, foam member 30*b* is compressed between the interior of walls 36 and 38 and foam member 30*c* is compressed between the interior of walls 38 and 34. The foam is compressed to ensure a compact fit (i.e. avoid unintentional air gaps between the foam member and the chamber walls). Additionally, compression of the foam member reduces pore size, which increases the capillary force within the foam. An increase in capillary force within the foam enhances the back pressure within the ink chamber. As used herein, the term "back pressure" means the capillary force within the pen chamber, which resists gravitational force and, hence, resists the flow of ink through the printhead. The back pressure within the ink reservoir or chamber helps to prevent ink leakage from the printhead.

Air is present throughout the ink that is stored in the porous foam members 30*a–c*. The air is often in the form of bubbles throughout the foam. Increasing ambient temperature or decreasing ambient pressure causes air diffusion from the ink, forming more air bubbles. These air bubbles are typically small and distributed generally uniformly throughout the foam member 30. However, the overall effect of a large number of such bubbles, especially when subjected to severe variations in ambient temperature or pressure, is for the bubbles to expand and displace an equivalent volume of ink.

In conventional foam ink storage systems, substantially all of the exterior surfaces of the foam member are in contact with the interior of the walls of the chamber over substantially the entire area of the walls. The air is trapped because areal contact between the ink saturated foam member and the reservoir wall creates a seal through which air is unable to pass between the foam and walls and escape through the atmospheric vent. If the ink displaced due to increased pressure has no other path to follow, some ink is forced through the printhead orifices, causing undesired printhead drool.

Referring to FIG. 2, the foam member 30 is not completely filled to the top with ink. The region of foam saturated with ink is known as the "wet zone" 31. There is a region of foam, nearest the ink supply aperture 22, that is void of ink due to hydrophobic characteristics of dry foam and the capillary forces of the saturated wet zone. This area is known as a "dry zone" 35 (FIG. 2). Between the dry zone 35 and the wet zone 31 is a narrow "damp zone" 33 which is wetted with ink but is not saturated. The damp zone 33 attracts additional ink by capillarity and thus provides back pressure for the pen.

During a volumetric change within the pen reservoirs 26*a–c* caused by temperature or pressure changes, the expansion of air within the ink is first accommodated by ink moving into the damp zone 33 of each foam member 30*a–c*. Once the damp zone 33 is saturated with ink, back pressure in the reservoir is reduced. Thus, the pen is unable to accommodate any additional air expansion without undesirable ink drool.

There are other, less significant damp zones or regions within the foam member but ink is unable to migrate into many of these regions due to air being trapped in such areas.

To facilitate the release of air bubbles in the ink, a multitude of channels are defined in the exterior portions of the porous foam member 30. That is, the walls of the channels are defined by the porous foam member 30. The foam member, as mentioned, has throughout its entire volume a multitude of pores and capillaries for storing ink.

Referring to FIGS. 2–6, in a preferred embodiment, a series of channels 154 extend linearly from the first end to the second end of the foam member 30, also referred to as a first direction (that is, the ends corresponding to the ends 260, 262 of the embodiment of FIG. 7). When the foam member 30 is inserted in the cartridge, the channels 154 preferably extend at an angle substantially perpendicular to a line between the top 28 and bottom 29 of the cartridge (i.e. horizontally). An angle other than perpendicular is acceptable. For reasons explained next, however, it is preferred that the orientation of the channels 154 do not provide a substantially continuous series of linear passageways or gaps between the top 28 and bottom 29 of the cartridge 10.

During the ink fill process, ink is forced into the porous foam member 30 at a relatively high rate. Approximately 20 grams of ink are forced into the foam member 30 within a period of 1 to 2 seconds. Referring to ink chamber 26*a*, for example, any continuous passageway or gap extending to the top 28 of the cartridge 10, (i.e. extending vertically)

between the interior of walls 32 or 36 and the foam member 30*a*, can result in ink flowing back through the relatively low fluid resistance of the gap. Thus, under the relatively high pressure exerted during the ink fill process, ink would flow back through these gaps to the top of the pen and out the ink supply apertures 22 rather than appropriately entering and saturating the foam member 30*a*.

Figure 5:
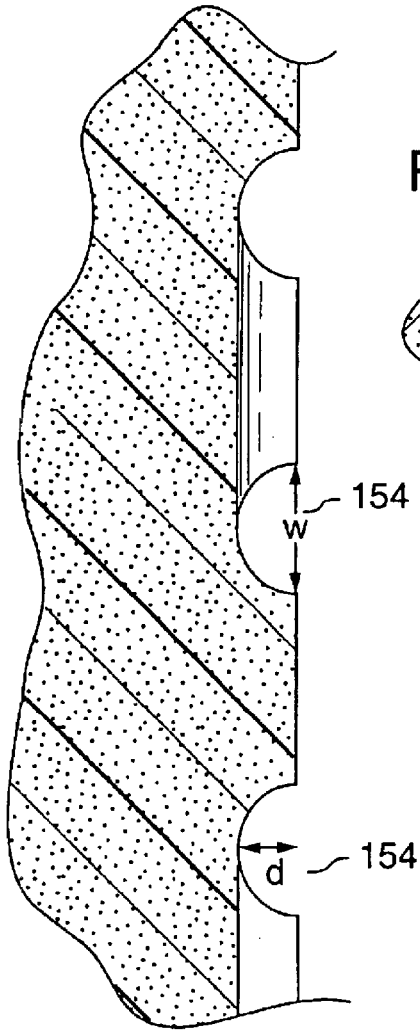
FIG. 5 is an enlarged cross-sectional side view of the foam in FIG. 4 taken along line 5—5.

An enlarged cross-section of channels 154, in a preferred embodiment of the present invention, is illustrated in FIG. 5. Each channel 154 is semi-circular in shape, with width "w", at the outermost edge of the channel (the cross-sectional width) being approximately 2.5 mm. A preferred cross-sectional depth "d", for each channel 154, is approximately 1.3 mm. In comparison to the channels, the pores and capillaries of the foam member 30 are much smaller in size. The pores and capillaries of the foam member 30 are approximately 0.2 mm in diameter. A preferred, felted, urethane foam has a porosity of approximately 5 pores/mm of foam.

Referring again to FIG. 4, in a preferred embodiment of the invention, the exterior of the foam member 30 also includes a plurality of grooves 156 which are contiguous communication with one or more channels 154. The grooves in the embodiments represented by FIGS. 2–6 are oriented substantially normal to the channels 154, extending in a second direction.

Figure 6:
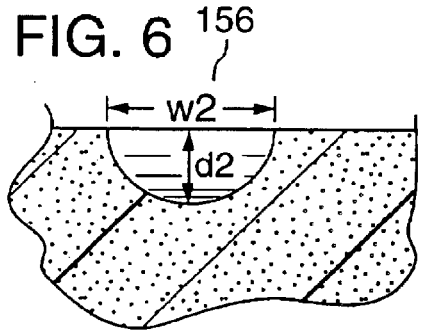
FIG. 6 is an enlarged cross-sectional view of the foam in FIG. 4 taken along line 6—6.

FIG. 6 presents an enlarged cross-section of the grooves 156. In a preferred embodiment, the groove 156 is semi-circular in shape (i.e. the same shape as channel 154 (FIG. 5)). A preferred groove cross-sectional width "w2" is approximately 2.3 mm and a preferred cross-sectional depth "d2" is approximately 1.2 mm.

The grooves 156 and channels 154 are defined by the porous foam member 30 such that the portions of the foam member between pairs of grooves and channels form equidistantly spaced protuberances 158.

Figure 4:
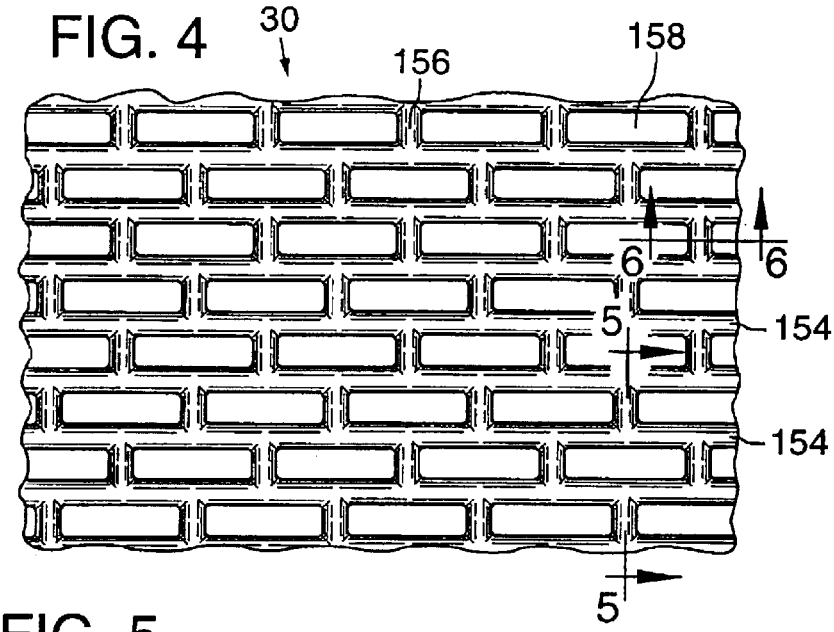
FIG. 4 is an enlarged partial side view of the foam constructed in accordance with a preferred embodiment of the present invention.

As shown in FIG. 4, the protuberances 158 are substantially rectangular in shape, oriented with long axes extending horizontally from the front side 16 to back side 18 of the cartridge 12. The protuberances 158 are configured in rows, each row offset from the adjacent row of protuberances. The offset row configuration of the embodiment represented in FIG. 4 result in a linearly discontinuous passageway extending from the bottom 50 to the top 48 of the foam member 30 (FIGS. 1 and 4). Thus, there is no linearly continuous passageway or gap between the interior of the walls of the chamber and the foam member 30 when a foam member is inserted within an ink chamber. As discussed above, this is useful for an effective ink filling process.

Figure 8:
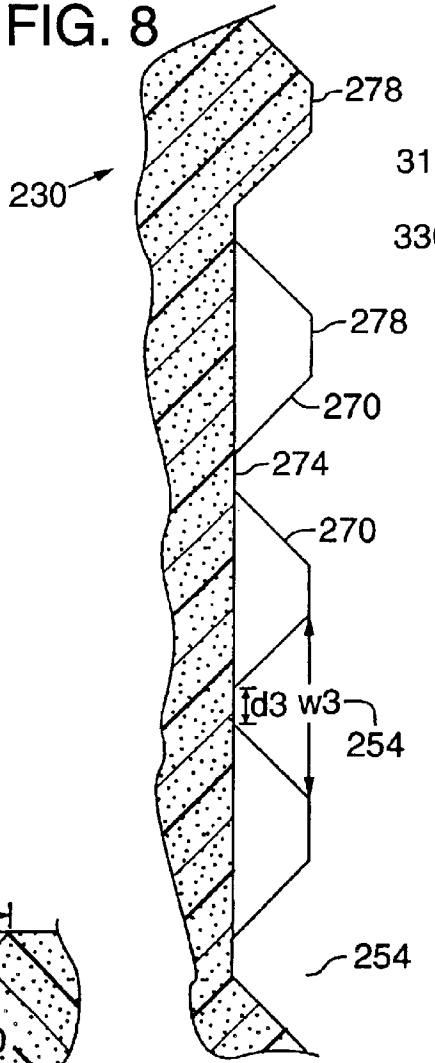
FIG. 8 is an enlarged cross-sectional view of the foam of FIG. 7 taken along line 8—8.
Figure 9:
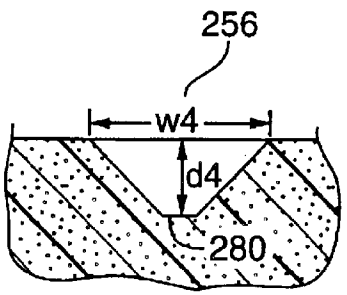
FIG. 9 is an enlarged cross-sectional view of the foam of FIG. 7 taken along line 9—9.

In another preferred embodiment of the present invention, represented in FIGS. 7–9, the foam member 130 is substantially rectangular in shape, and includes channels 254, grooves 256 and protuberances 278.

A series of channels 254 extend linearly from the first end 260 to the second end 262 of the foam member 130 (also referred to as a first direction). When the foam member 130 is inserted in the cartridge, the channels 254 extend substantially normal to a line between the top 28 and bottom 29 of the cartridge (i.e. horizontally). An angle of less than 90° is acceptable. Preferably, however the channels 254 should not provide a substantially continuous series of linear passageways or gaps between the top 28 and bottom 29 of the cartridge 10.

FIG. 8 presents an enlarged cross-section of channels 254, defined within the foam member 130. Each channel 254 is defined by a flat base 274 that is about 0.4 mm wide. The walls 270 of each channel 254 diverge from the base 274 at about a 45° angle. In a preferred embodiment, the outermost cross-sectional width "w3" of each channel 254 is approximately 2.4 mm.

The foam member 130 includes vertical grooves 256. FIG. 9 presents an enlarged cross-section of the groove 256. The grooves are substantially the same shape as channels 254 (FIG. 8). That is, each groove 256 is defined by a flat base 280 that is about 0.4 mm wide. The walls of each groove 256 diverge from the base 280 at approximately a 45° angle. The outermost cross-sectional width "w4" of groove 256 is approximately 2.4 mm, and the cross-sectional depth "d4" of the groove is preferably about 1.0 mm.

The foam member 130 also defines rows of protuberances 258. The grooves 256 are arranged in spaced apart groups so that there are no linearly continuous vertical paths through the rows 258 from the bottom 50 to the top 48 of the foam member 230 (FIG. 7).

The liquid ink contained by the relatively small capillaries and pores of the foam member will remain within the ink-saturated foam rather than flowing into the relatively larger grooves and channels. In each of the above-described embodiments, the grooves and channels are coupled such that air may move between them. The grooves, which considered together with the channels, form tortuous, fluidly continuous air passageways or gaps which lead to the ink chamber atmospheric vent.

In each embodiment of the present invention, the cross-sectional depth and width of the channels and grooves are sufficiently deep and wide, respectively, such that there remain continuous passageways between the walls of the chamber and the foam member when the foam is compressed. The effect of this fluid communication allows trapped and expanding air within the ink-saturated foam and within the chamber itself to escape through, the passageways to the vent, when the ambient pressure or temperature change.

Another effect of the present invention is that the grooved surface portion of the foam member adjacent to the foam wet zone may serve as a "damp zone." Thus, ink can move into this region when air within the foam expands since air that occupied the region is now able to escape through the fluidly continuous air passageways. This increased damp zone greatly enhances the cartridges ability to tolerate ambient condition changes of a severity such that the foams capillarity may be temporarily overcome.

Figure 10:
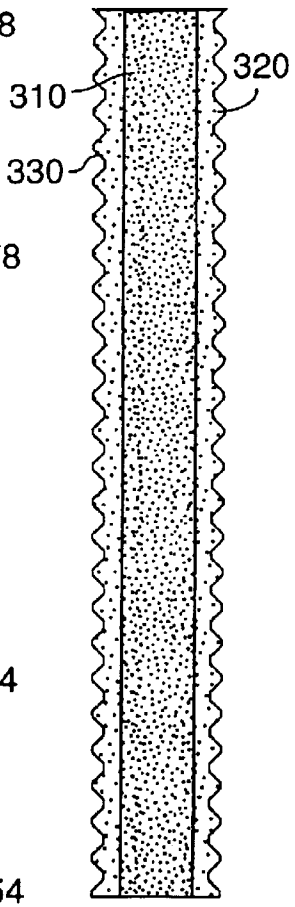
FIG. 10 is an end view of an alternative version of the foam member of the present invention.

In another preferred embodiment, three pieces of porous foam are laminated together in a sandwich-type configuration (FIG. 10). The interior portion of foam 310 possesses a substantially smaller porosity than the porosity of the exterior portions of foam 320, 330. When the foam is saturated with ink, ink is drawn to the smaller pores and capillaries of the interior portion of foam.

Preferably, the pores (and capillaries) of the interior foam member are approximately 0.2 mm in diameter, while the pores of the two exterior foam members are about 1 mm in diameter. Stated another way, a preferred, felted, polyurethane interior foam member will have about 5 pores/mm of foam, and the exterior foam members have about 1 pores/mm. With a large foam pore size difference, ink will not occupy the exterior portion of the foam member 30*a–c* until the interior is saturated.

The unsaturated outer layers of foam provide at least one fluidly continuous air passageway. Thus, as the ambient temperature or pressure changes, trapped and expanding air within the ink saturated interior foam, and the chamber itself, can escape through these passages to atmosphere. Such a preferred embodiment also transforms the entire border of the inner and outer layers of foam into a "damp zone" in which ink can migrate during such volumetric challenges.

Having illustrated and described the principles of the invention, it should be apparent to those persons skilled in the art that the illustrated embodiments may be modified without departing from such principles. We claim as our invention all such embodiments that may come within the scope and spirit of the following claims and equivalents thereto.

What is claimed is:

1. A fluid storage device for an ink-jet pen, comprising:

a porous fluid storage medium having an interior portion and an exterior portion, the medium having pores therethrough for storing ink;

channels defined by and in the exterior portion of the porous fluid storage medium wherein the channels are of substantially larger dimensions than the pores of the fluid storage medium and are in fluid communication with the pores of the porous fluid storage medium; and wherein the channels are connected by grooves that extend across the fluid storage medium.

2. The fluid storage device of claim 1 wherein the channels extend substantially continuously across the storage medium in a first direction.

3. The fluid stone device of claim 2 wherein the channels are linearly continuous in the first direction.

4. The fluid storage device of claim 2 wherein the grooves extend across the fluid storage medium in a second direction that is substantially perpendicular to the first direction.

5. The fluid storage device of claim 1 wherein each of the channels has a cross sectional width that is substantially larger than a cross sectional width of each of the pores of the porous fluid storage medium.

6. The fluid storage device of claim 1 wherein each channel has a cross sectional depth that is substantially larger than a cross sectional width of any pore of the porous fluid medium.

7. The fluid storage device of claim 1 wherein the grooves are disposed transverse to the channels and wherein each of the channels is coupled by at least one of the grooves to at least one other channel.

8. The fluid storage device of claim 7 wherein the grooves and channels combine to form at least one tortuous passageway extending from a bottom of the fluid storage medium to a top of the fluid storage medium.

9. The fluid storage device of claim 1 including a body defining at least one reservoir, the reservoir having opposing interior walls and wherein the fluid storage medium is disposed between the opposing interior walls and configured so that the channels and connecting grooves are formed on opposing sides of the fluid storage medium.

10. The fluid storage device of claim 9 wherein the cross sectional depth of each of substantially all of the channels of the exterior portion is sufficient so that the channels are present in the fluid storage medium even as the fluid storage medium is compressed between the opposing interior walls of the reservoir.

11. The device of claim 1 wherein the interior portion of the medium is sandwiched between two pieces of the exterior portion of the medium, which exterior portion is formed with pores that are relatively larger in cross section relative to the pores in the interior portion of the medium.

12. A fluid storage device for an ink-jet pen, comprising:

a body having substantially flat side walls and a bottom and a vented top; and a porous fluid storage medium disposed between the side walls and beneath the top, the fluid storage medium having an interior portion and an exterior portion, and channels defined by and in the exterior portion of the porous fluid storage medium, the channels extending in a first direction that is substantially perpendicular to a line that extends between the bottom and the top of the body.

13. The device of claim 12 including grooves extending between and connecting pairs of the channels.

14. The device of claim 13 wherein the grooves extend in a direction that is perpendicular to the first direction.

15. The device of claim 14 wherein the grooves are arranged to extend linearly discontinuously between the bottom and the top of the body.

16. The fluid storage device of claim 12 wherein the flat walls have no grooves or protruding ribs and the porous fluid storage medium includes pores throughout the medium.

17. The fluid storage device of claim 12 wherein each channel has a width and each of the pores located in the interior portion of the storage medium has a width that is relatively smaller than the width of any one of the channels.

18. A fluid storage device for an ink-jet pen, comprising:

a porous fluid storage medium having an exterior;

channels and grooves that are defined by and in the exterior of the medium thereby to form substantially linear rows of protrubences, and wherein the channels and the grooves are present on opposing sides of the medium, and the rows being offset to establish linearly discontinuous passageways through the rows of protuberances.

19. The device of claim 18 wherein the channels and grooves are oriented to be substantially perpendicular.

20. A method of storing liquid in a reservoir that has a bottom and a top that is vented ambient air, comprising the steps of:

providing in the reservoir a compressible porous fluid storage medium having an interior portion and an exterior portion, the medium having pores therethrough for storing fluid;

shaping the medium to have channels within the exterior portion of the fluid storage medium; and arranging the channels to define linearly discontinuous passageways from the bottom to the top of the reservoir.

21. A method of storing liquid in a reservoir that has a bottom and a top that is vented to ambient air, comprising the steps of:

providing in the reservoir a compressible porous fluid storage, medium having an interior portion and an exterior portion, the medium having pores therethrough for storing fluid;

shaping the medium to have channels within the exterior portion of the fluid storage medium; and compressing the medium within the reservoir.

22. A method of storing liquid in a reservoir that has a bottom and a top that is vented to ambient air comprising the steps of:

providing in the reservoir a compressible porous fluid storage medium having an interior portion and an exterior portion, the medium having pores therethrough for storing fluid;

shaping the medium to have channels within the exterior portion of the fluid storage medium; and the medium with an interior portion that is sandwiched between exterior portions of the medium, which exterior portions are formed with pores that are relatively larger in cross section relative to the pores in the interior portion of the medium.

23. A fluid storage device for an ink-jet pen, comprising:

a porous fluid storage medium having an interior portion and an exterior portion, the medium having pores therethrough for storing ink;

channels defined by and in the exterior portion of the porous fluid storage medium wherein the channels are connected by grooves that extend across the fluid storage medium; and a body defining at least one reservoir, the reservoir having opposing interior walls and wherein the fluid storage medium is disposed between the opposing interior walls and configured so that the channels and connecting grooves are formed on opposing sides of the fluid storage medium.

24. A fluid storage device for an ink-jet pen, comprising:

a porous fluid storage medium having an interior portion and an exterior portion, the medium having pores therethrough for storing ink;

channels defined by and in the exterior portion of the porous fluid storage medium wherein the channels are connected by grooves that extend across the fluid storage medium; and wherein the interior portion of the medium in sandwiched between two pieces of the exterior portion of the medium, which exterior portion is formed with pores that are relatively larger in cross section relative to the pores in the interior portion of the medium.

* * * * *

UNITED STATES PATENT AND TRADEMARK OFFICE

CERTIFICATE OF CORRECTION

PATENT NO. : 6,890,068 B2
APPLICATION NO. : 10/309869
DATED : May 10, 2005
INVENTOR(S) : Kawamura et al.

It is certified that error appears in the above-identified patent and that said Letters Patent is hereby corrected as shown below:

In the Claims

Col. 7 (line 27), delete “stone” and insert therefor --storage--.

Col. 8 (line 51), delete “storage,” and insert therefor --storage--.

Col. 8 (line 66), before “the medium”, insert --making--.

Signed and Sealed this

Fifth Day of September, 2006

JON W. DUDAS
*Director of the United States Patent and Trademark Office*